US010900736B2

(12) United States Patent
Beachli et al.

(10) Patent No.: US 10,900,736 B2
(45) **Date of Patent: *Jan. 26, 2021**

(54) RETRACTABLE FIREARM SUPPORT ASSEMBLY

(71) Applicant: BLK LBL CORPORATION, Calgary (CA)

(72) Inventors: Dalton Francis Beachli, Calgary (CA); Juraj Antonak, Calgary (CA)

(73) Assignee: BLK LBL CORPORATION, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,528

(22) Filed: Feb. 21, 2020

(65) Prior Publication Data

US 2020/0200501 A1 Jun. 25, 2020

Related U.S. Application Data

(63) Continuation of application No. 16/082,176, filed as application No. PCT/CA2017/050217 on Feb. 21, 2017, now Pat. No. 10,591,240.

(Continued)

(51) Int. Cl.
*F41A 23/10* (2006.01)
*F41A 23/08* (2006.01)

(52) U.S. Cl.
CPC ..... *F41A 23/10* (2013.01); *F41A 23/08* (2013.01)

(58) Field of Classification Search
CPC ..... F41A 23/10; F41A 23/08; F41A 23/02

(Continued)

(56) References Cited

U.S. PATENT DOCUMENTS 2,807,904 A 10/1957 Kreske
4,265,045 A 5/1981 Garbini (Continued)

FOREIGN PATENT DOCUMENTS

GB 1191389 5/1970
GB 2456545 A 7/2009
WO 2012009427 A2 1/2012

OTHER PUBLICATIONS

International Search Report and Written Opinion dated May 19, 2017 issued for PCT Application PCT/CA2017/050217.

*Primary Examiner* — John Cooper
(74) *Attorney, Agent, or Firm* — Heslin Rothenberg Farley & Mesiti P.C.

(57) ABSTRACT

A retractable support assembly for a firearm. The assembly includes a swiveling support structure configured for attachment to or adjacent to the forward end of a firearm extension component on the firearm. The support structure is substantially centered on the longitudinal axis of the firearm barrel and permits movement of the longitudinal axis of the firearm barrel relative to a position fixed by deployment of the assembly for variable aiming of the firearm. The support structure has a central ball unit defined by a channel for passage of a barrel of the firearm. The ball unit is configured for rotatable movement within a socket formed by a rearward ball retention element and a forward ball retention element. The assembly includes a plurality of legs pivotably connected to the support structure for movement between an extended position and a retracted position.

20 Claims, 11 Drawing Sheets

Related U.S. Application Data

(60) Provisional application No. 62/304,035, filed on Mar. 4, 2016.

(58) Field of Classification Search
USPC .... 42/94, 73; 89/37.01, 37.03, 37.04, 40.01; 73/167
See application file for complete search history.

(56) References Cited

U.S. PATENT DOCUMENTS

| | | | | |
|---|---|---|---|---|
| 5,194,678 | A | 3/1993 | Kramer | |
| 5,852,892 | A | 12/1998 | Bilgeri et al. | |
| 6,293,041 | B2 | 8/2001 | Weaver | |
| 6,289,622 | B1 | 9/2001 | Desch, Jr. et al. | |
| 6,763,627 | B1 | 7/2004 | Kaempe | |
| 6,785,997 | B2 | 9/2004 | Oz | |
| 6,843,015 | B2 | 1/2005 | Sharp | |
| 7,421,815 | B1 | 9/2008 | Moody et al. | |
| 7,426,800 | B2 | 9/2008 | Pierce et al. | |
| 7,478,496 | B2 | 1/2009 | Bender | |
| 7,571,563 | B2 | 8/2009 | Peterson | |
| 7,631,455 | B2 | 12/2009 | Keng et al. | |
| 7,676,977 | B1 * | 3/2010 | Cahill | F41G 11/003 42/94 |
| 7,793,454 | B1 | 9/2010 | Beltz | |
| 7,954,272 | B2 | 6/2011 | Potterfield et al. | |
| 7,992,339 | B2 | 8/2011 | Hinds, Jr. | |
| 8,104,213 | B2 | 1/2012 | Keng et al. | |
| 8,413,569 | B1 | 4/2013 | Helton | |
| 8,443,540 | B2 | 5/2013 | Poling | |
| 8,567,106 | B2 | 10/2013 | Chvala | |
| 2003/0192223 | A1 | 10/2003 | Sharp | |
| 2007/0094912 | A1 * | 5/2007 | Bender | F41A 23/10 42/94 |
| 2008/0307689 | A1 | 12/2008 | Dotson | |
| 2009/0126250 | A1 * | 5/2009 | Keng | F41A 23/10 42/94 |
| 2010/0192449 | A1 | 8/2010 | Hinds, Jr. | |
| 2011/0265366 | A1 | 11/2011 | Hinds, Jr. | |
| 2013/0205639 | A1 * | 8/2013 | Poling | F41A 23/08 42/94 |
| 2015/0121741 | A1 | 5/2015 | Bowman | |
| 2015/0241160 | A1 * | 8/2015 | McGinty | F41A 23/10 42/94 |
| 2016/0265864 | A1 * | 9/2016 | Poling | F41A 23/10 |
| 2019/0041156 | A1 * | 2/2019 | Beachli | F41A 23/10 |

* cited by examiner

RETRACTABLE FIREARM SUPPORT ASSEMBLY

CROSS-REFERENCE TO RELATED APPLICATIONS

This application is a continuation of U.S. patent application Ser. No. 16/082,176 filed under 35 U.S.C. § 371 on Sep. 4, 2018 as a National Stage entry of PCT/CA2017/050217 filed on 21 Feb. 21, 2017, which itself claims priority to U.S. Provisional Patent Application Ser. No. 62/304,035 filed on Mar. 4, 2016, the entire disclosures of which are incorporated herein by reference in entirety.

FIELD OF THE INVENTION

The invention relates generally to the field of functional firearm accessories and more specifically to assemblies for supporting firearms during use.

BACKGROUND OF THE INVENTION

When shooting rifles and other firearms in sport or tactical situations, it is important that the firearm be maintained in a steady, stable position to insure accuracy of aim. Most shooters are not able to hold a firearm consistently in a set position without wavering, especially after the onset of fatigue resulting from strain due to the size and weight of the firearm.

Accordingly, peripheral support devices have been used in conjunction with firearms since the early creation of firearms as a means of stabilizing a firearm to reduce wavering and to improve accuracy.

In the past, shooters have used everything from large stationary objects such as rocks and tree branches to forked sticks, shooting slings, bipods and tripods. Early bipod and tripod supports typically were somewhat crude assemblies that generally were bulky, inconvenient and difficult to use and typically were not easily adjustable. In more recent times, supports have been developed that are compact and relatively lightweight and are mountable to the stock forearm of a firearm, such as a rifle, to make the bipods portable with the firearm. Most conventional supports include a pair of legs that can be pivoted from an up position adjacent the firearm stock, to a down position engaging a support surface, with the legs being optionally extensible to adjust the height of the support.

Most supports are not designed for quick and easy attachment and release of the support from the firearm stock. Other types of conventional supports offer varying types of mountings that can be fitted to various types of rifles without requiring modification or machining of the rifle stock. However, these support mounts do not provide for quickly releasing an attached support from the firearm.

Examples of firearm support assemblies are described in U.S. Pat. Nos. 8,567,106, 8,443,540, 8,413,569, 8,104,213, 7,954,272, 7,992,339, 7,676,977, 7,631,455, 7,478,496, 7,426,800, 7,421,815, 6,763,627, 6,785,997 6,293,041, 6,289,622, 5,194,678, 4,265,045 and 2,807,904, US Patent Application Publication Nos. 2015012174 20150241160, 20110265366, 20100192449, 20090126250, 20080307689, 20030192223, GB Patents 2456545 and 1191389 and International Patent Publication No. WO2012009427, each of which is incorporated herein by reference in its entirety.

A need exists for improvements over known firearm support assemblies which provide enhanced capabilities that do not impede the operation of firearms in sport and tactical situations.

SUMMARY OF THE INVENTION

One aspect of the invention is a retractable support assembly for a firearm, the assembly comprising: a swiveling support structure configured for attachment to or adjacent to the forward end of a firearm extension component on the firearm, the support structure, when attached, being substantially centered on the longitudinal axis of the firearm barrel and permitting movement of the longitudinal axis of the firearm barrel relative to a position fixed by deployment of the assembly for variable aiming of the firearm; a plurality of legs pivotably connected to the support structure for movement between an extended position wherein the assembly supports the outer end of the longitudinal axis of the firearm and a retracted position; and a leg-locking mechanism connected to the support structure for locking the legs in the extended position.

In some embodiments, each of the legs resides within a corresponding relief area provided in the extension component with a surface of each leg forming part of the outer contour of the extension component.

In some embodiments, the firearm extension component is a handguard, gunstock, shroud, or chassis.

In some embodiments, the support structure comprises a central ball unit configured for rotatable movement within a socket, wherein the plurality of legs is a pair of legs connected to opposing sides of the ball unit or to the socket.

In some embodiments, the pair of legs is connected to opposing sides of the ball unit and the socket is formed by rearward and forward ball retention elements each including curved inner ball contact surfaces, wherein the rearward retention element is substantially immobilized relative to the extension component.

In some embodiments, immobilization of the rearward retention element is effected by direct or indirect connection of the rearward retention element to the extension component.

In some embodiments, the extension component includes a bottom brace member and the bottom of the rearward retention element is connected to the brace member.

In some embodiments, the ball unit is defined by a channel for passage of the firearm's barrel therethrough.

In some embodiments, the locking mechanism is provided by a pair of opposing buttons placed in corresponding openings in the ball unit, each button movable between a locked position which prevents movement of the corresponding leg and an unlocked position which allows movement of the corresponding leg between the retracted and extended positions.

In some embodiments, the buttons are each connected to the ball unit by an axle extending through a button axle channel and into opposing ball axle channels, the axle providing a pivot axis for movement between the locked position and the unlocked position.

In some embodiments, the ball unit is defined by a pair of opposed cut away sections, each providing a connection point for pivot pin connection of a leg joint to the ball unit and allowing movement of the leg joint between the extended and retracted positions via pivoting of the leg at the pivot point.

In some embodiments, each button includes a locking lever configured to rest inside an extension lock groove of the leg joint when the corresponding leg is extended and locked, and configured to rest inside a retraction groove of the leg joint when the corresponding leg is retracted, wherein the locked position requires force on the top end of the button to move the locking lever lock groove to move to the unlocked position.

In some embodiments, the rearward retention element is defined by opposed lower grooves aligned with the corresponding cut away sections to provide a space for the corresponding legs.

In some embodiments, the support assembly further comprises an adjustment mechanism provided by a tensioner ring configured to exert variable pressure on a spring member located between the tensioner ring and the forward retention element, wherein rotation of the tensioner ring in one direction causes tightening of pivoting motion of the ball and wherein rotation of the tensioner ring in the other direction causes loosening of the pivoting motion of the ball.

In some embodiments, the support assembly further comprises an outer housing for generally covering the tensioner ring and the forward ball retention element, the outer housing having side windows for a user to access and control the tensioner ring.

In some embodiments, the outer housing is immobilized with respect to the extension component by connection of the top of the outer housing to the top of the extension component with an elongated member.

In some embodiments, the elongated member is a Picatinny rail, a Weaver rail or a 1913 rail.

In some embodiments, the length of each of the legs is adjustable.

In some embodiments, movement of the longitudinal axis of the firearm is restricted to rolling motion caused by rotation of the longitudinal axis and to yaw motion caused by rotation of the vertical axis.

Another aspect of the invention is a kit of parts for installing a retractable support assembly on a firearm, the kit comprising the parts of the support assembly as recited herein and instructions for constructing the assembly on the firearm.

In some embodiments, the kit further comprises a handguard as the extension component, the handguard configured for attachment to a firearm in a conventional manner and defined by a pair of leg relief areas for holding the legs of the assembly in the retracted position.

In some embodiments, the handguard has an outer surface contour shaped to be continuous with outer surfaces of the legs in the retracted position, thereby providing a smooth combination of leg and handguard surfaces for facile gripping of the handguard and legs by a user.

In some embodiments, the kit further comprises operational instructions describing leg extension and retraction and operation of the locking mechanism associated therewith.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Rationale

Figure 1A:
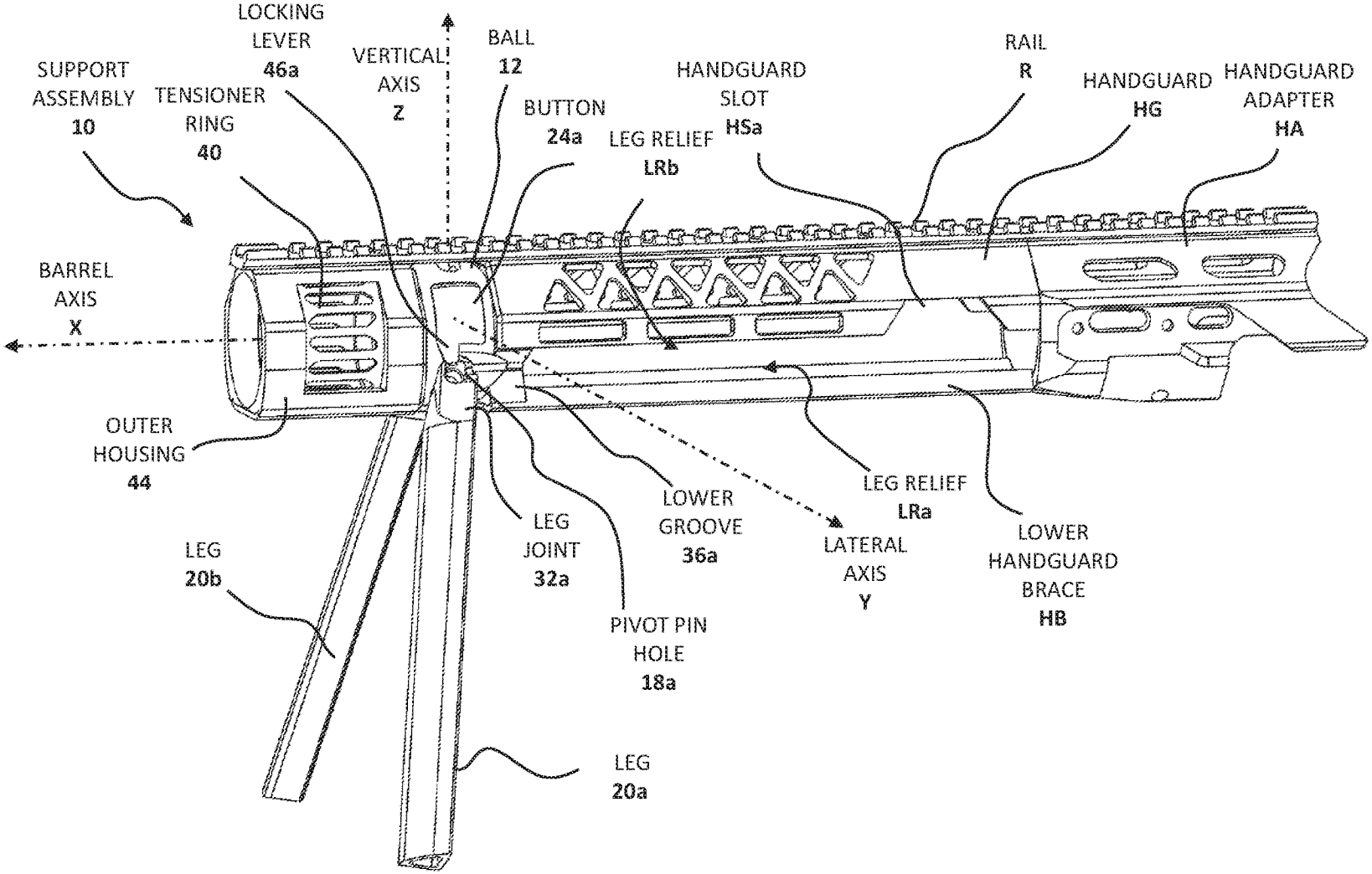
FIG. 1A is a perspective view of the support assembly of one embodiment of the invention 10 connected to a handguard HG and associated handguard adapter HA for a firearm with the legs 20*a* and 20*b* of the support assembly 10 shown in the extended position.

In many situations, the use of firearms in sport (for example in hunting or target shooting) or in tactical situations (for example, in police or military engagements) it is desirable to support a firearm on a stand. It is also desirable to carry the firearm to a new location and the presence of such stands can cause impediments, particularly in forested or congested areas. Retractable support stands are known but in most cases, they either retract to positions below the handguard or stock where they may interfere with the user's movements, or they tend to be incapable of allowing convenient movement of the barrel during aiming of the firearm while the support stand is deployed.

The present invention addresses these shortcomings by providing a firearm support structure which is substantially centered on the longitudinal axis (X axis) of the firearm barrel and which permits movements of the barrel which are conducive to aiming while maintaining the support function of the support structure. An additional feature is that the legs retract into leg relief areas provided in an extension component of the firearm which may be a handguard, stock, shroud, chassis, or other component associated with the firearm.

A number of possible alternative features are introduced during the course of this description. It is to be understood that, according to the knowledge and judgment of persons skilled in the art, such alternative features may be substituted in various combinations to arrive at different embodiments of the present invention.

A First Embodiment of a Retractable Firearm Support Assembly

Various aspects of the invention will now be described with reference to FIGS. 1 to 9 which describe one embodiment of the invention.

It is to be understood that groups of components sharing the same reference numeral and having an additional letter identifier (e.g. 18*a* and 18*b*) represent structurally and functionally similar components which may be identical, substantially identical, symmetrical, or mirror images of each other. Because the exemplary embodiment is described with reference to perspective drawings, certain components existing in pairs may have only one of the two paired components visible in a given perspective drawing. It is to be understood from context and symmetry which is readily apparent to the skilled person, that any non-visible component of the pair described with respect to a particular drawing is nonetheless present. Components identified using only letters (e.g. HG, R and HB) refer to components which do not form part of the main support assembly of the invention but are connected to or otherwise associated with the support assembly in the example embodiments. Certain kit embodiments of the invention may include such components.

Structural and functional features of the support assembly will be introduced and then exemplary steps used in construction of the support assembly and the operation of the support assembly will be described.

Figure 1B:
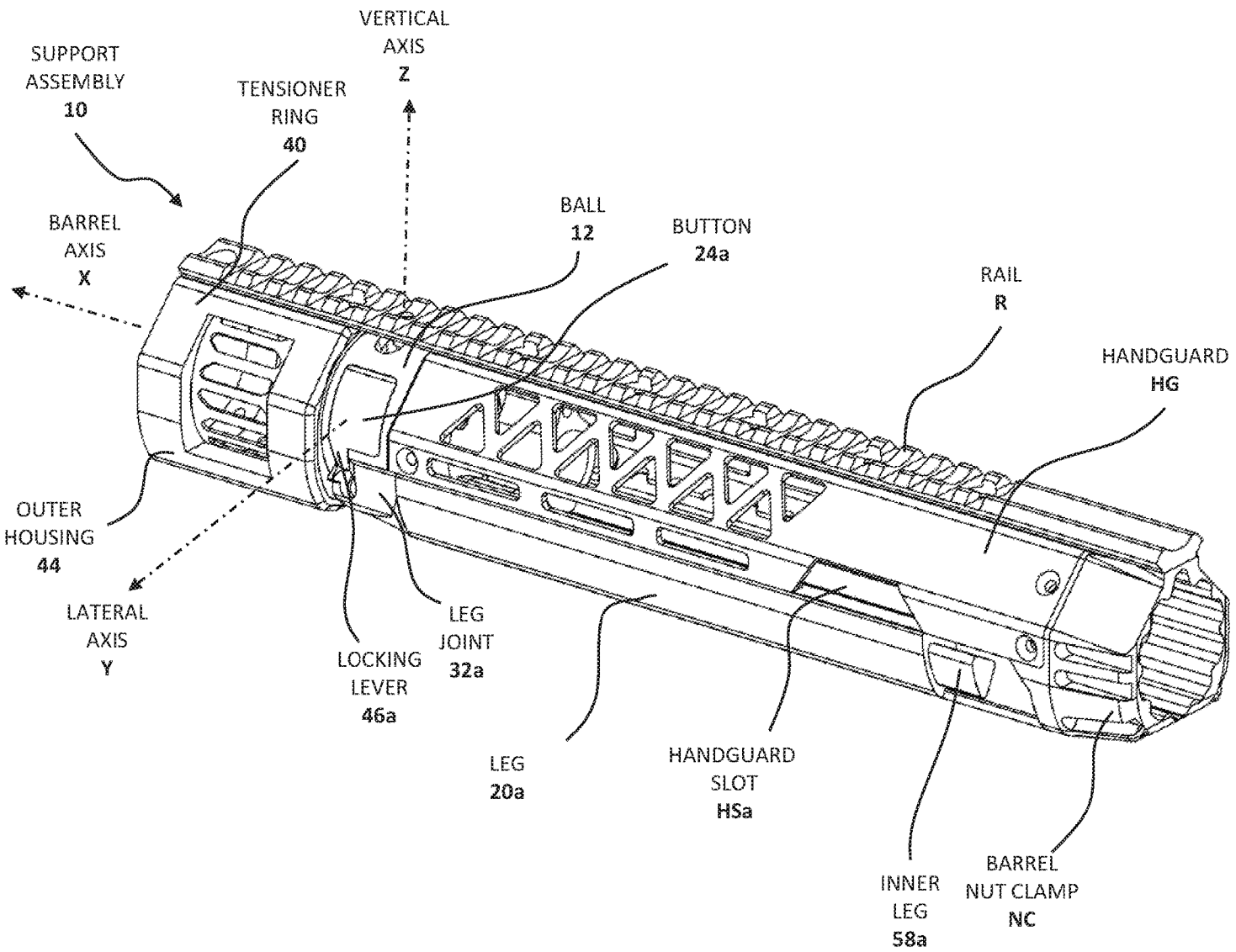
FIG. 1B is a perspective view of the support assembly of the same embodiment of FIG. 1A with the legs of the support assembly shown in the retracted position and with a barrel nut clamp NC in place of the handguard adapter HA.

Turning now to FIGS. 1A and 1B, there is shown one embodiment of a support assembly 10 for a firearm in the extended or deployed position (FIG. 1A) and in the retracted position (FIG. 1B). The firearm structure itself is not shown in order to simplify the description of the components of the support assembly 10. It is to be understood that the handguard HG, the lower handguard brace HB, the barrel nut clamp NC, the rail R and the handguard adapter HA are extension components which do not form part of the support assembly 10 and are configured for connection to the firearm in a conventional manner. The handguard HG and the lower handguard brace HB are designed to provide spaces to be occupied by the legs in the retracted position. These spaces are designated as leg reliefs LRa and LRb (both of which are visible as a continuous internal space in FIG. 1A, where leg relief LRb is in back of leg relief LRa). The design of extension components compatible with embodiments of the invention may vary substantially, as they are illustrated solely for the purpose of providing points of connection of the support assembly to the firearm and the skilled person will recognize that a number of variations are possible, which are within the scope of the invention.

The support assembly 10 is shown attached to the forward end of the handguard HG which in FIG. 1, is attached to a handguard adapter HA, whose presence may or may not be required, depending on the equipment included with a given firearm. In some embodiments the handguard adapter HA and the handguard HG may be a single component. When the support assembly 10 is attached to a firearm, the barrel of the firearm will extend along the longitudinal barrel axis X, and in most cases, will extend through the end opening of the outer housing 44 in the support assembly 10. Also shown are the lateral axis Y and the vertical axis Z. As described in more detail hereinbelow, with reference to FIG. 4D, rotation about the X axis (in a manner analogous to the "roll" of an aircraft), is permitted and rotation about the Z axis (in a manner analogous to the "yaw" of an aircraft) is permitted, but rotation about the Y axis (in a manner analogous to the "pitch" of an aircraft) is not permitted because such motion would interfere with the support function.

It is seen in FIG. 1B that the retracted leg 20*a* fits into the leg relief LRa (not visible in FIG. 1B) with the outer surface of the leg 20*a* matching the general contour of the handguard HG to provide a gripping surface with a continuous profile. While not visible in FIG. 1B, it is to be understood that the other side of the handguard HG is defined by a similar leg relief LRb to accommodate retraction of the other leg 20*b*. In this particular embodiment, each of the legs 20*a* and 20*b* is retained in the retracted position by the attractive force of complementary magnets (not shown) with one magnet positioned on each of the legs 20*a* and 20*b* and corresponding complementary magnets placed on the handguard HG at locations adjacent to the leg reliefs LRa and LRb so that towards the end of the movement of each leg to the retracted position, the attractive force between each pair of magnets will urge each leg into its corresponding retracted position and retain it with an attractive force which must be overcome by the user to move the legs 20*a* and 20*b* to their extended positions.

The central component of the support assembly 10 is a ball unit 12 (seen in FIGS. 2, 3 and 4A-4D which is held between opposing ball retention elements including a rearward ball retention element 14 and a forward ball retention element 16, which each have inner cup-shaped sidewalls that together form a socket for holding the ball unit 12 in a manner that allows swiveling of the support assembly 10 for aiming of the firearm when the support assembly 10 is in the extended (deployed) position (with the legs pointing downward as shown in FIG. 1A). The XYZ axes shown in FIGS. 1A and 1B emanate from the center of the ball unit 12. The structures of the ball retention elements 14 and 16 will be described in more detail hereinbelow, following a description of selected features of the ball unit 12.

The ball unit 12 has a pair of matched holes for pivotable attachment of a pair of matched legs 20*a* and 20*b* using hex screws, for example. The legs 20*a* and 20*b* pivot on the axis of the pivot hex screws in the pivot pin holes 18*a* and 18*b* thereby allowing movement of the legs 20*a* and 20*b* from the extended position shown in FIG. 1A to the retracted position shown in FIG. 1B. The legs 20*a* and 20*b* are lockable in the deployed position and retained in the retracted position by magnets. Alternative embodiments are provided with alternate locking and retention mechanisms. Alternative embodiments include a third leg (to provide a tripod-type support) with the third leg also fitting into a corresponding third leg relief in the firearm extension (not shown). The skilled person has the ability to redesign the ball unit and the firearm extension such as a handguard, stock, shroud or chassis to accommodate such a third leg in the retracted position in accordance with design principles described herein, without undue experimentation.

Additional features of the ball unit 12 will now be described. As shown in the views of FIGS. 4A to 4D, the ball unit 12 has a pair of cut away portions 22*a* and 22*b* for the purpose of providing a space for the legs 20*a* and 20*b* to occupy when they are in their retracted positions. FIG. 1B indicates that the leg 20*a* occupies the leg relief LRa when the leg 20*a* is in the retracted position. The legs 20*a* and 20*b* are connected to the ball unit 12 via leg joints 32*a* and 32*b*. Features of the leg joints 32*a* and 32*b* involved in the leg locking mechanism will be described in detail hereinbelow.

Figure 4B:
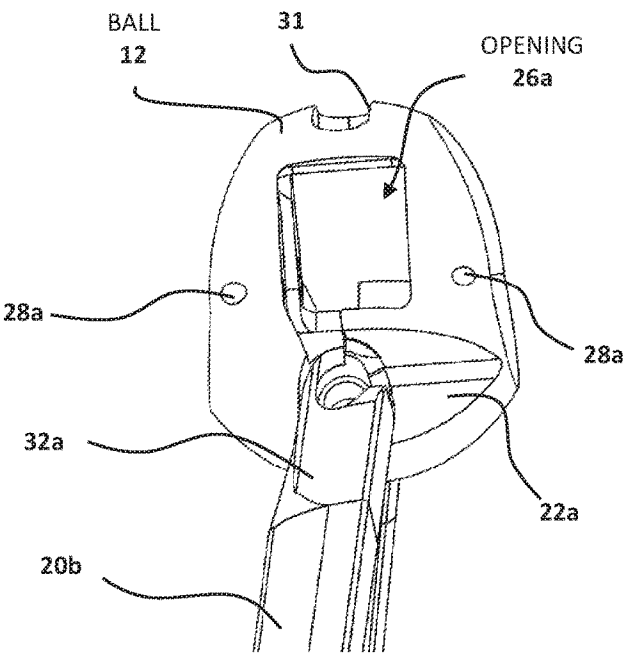
FIG. 4B is another side perspective view of the ball unit 12 and other selected components connected thereto, with button 24*a* removed.
Figure 4A:
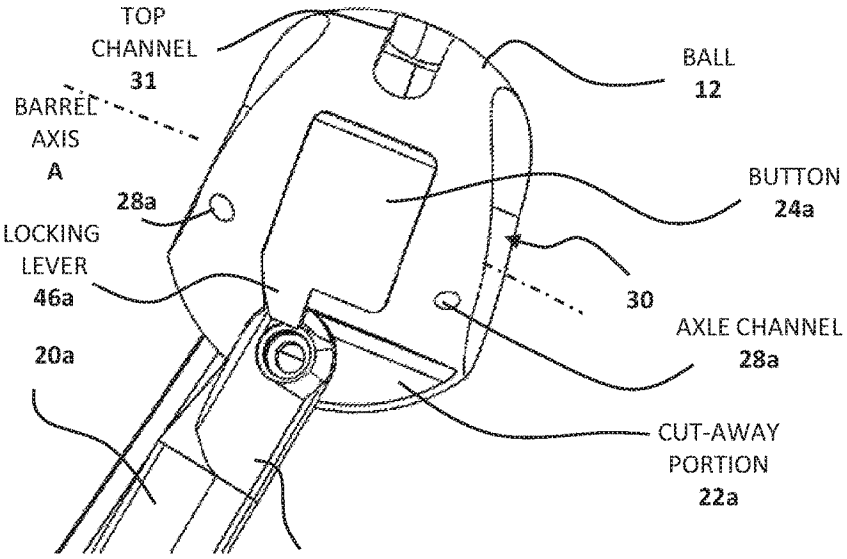
FIG. 4A is a side perspective view showing detail of features of the ball unit 12 and other selected components connected thereto.
Figure 4C:
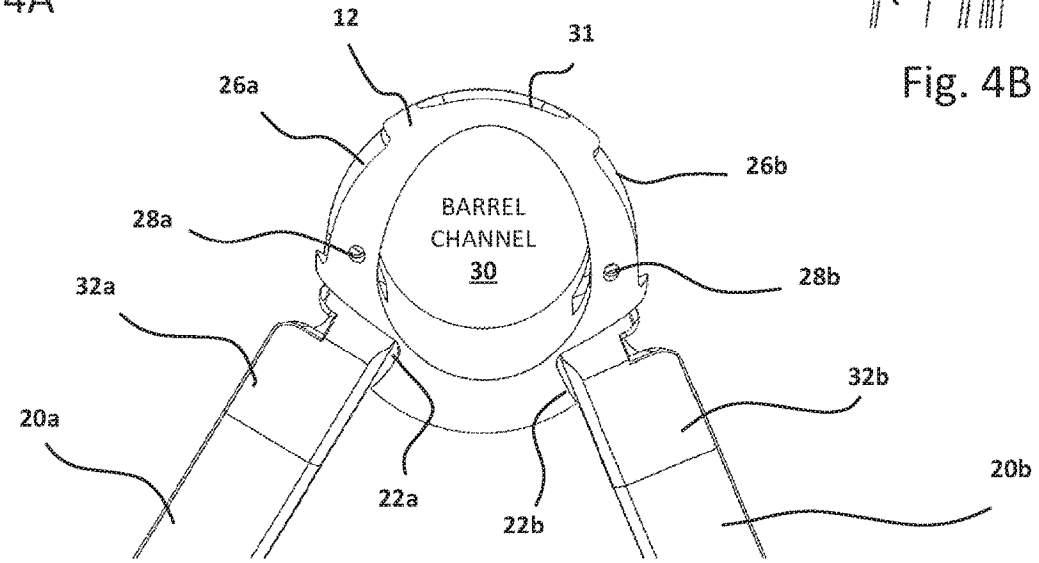
FIG. 4C is a back perspective view of the ball unit 12 and other selected components connected thereto.
Figure 6:
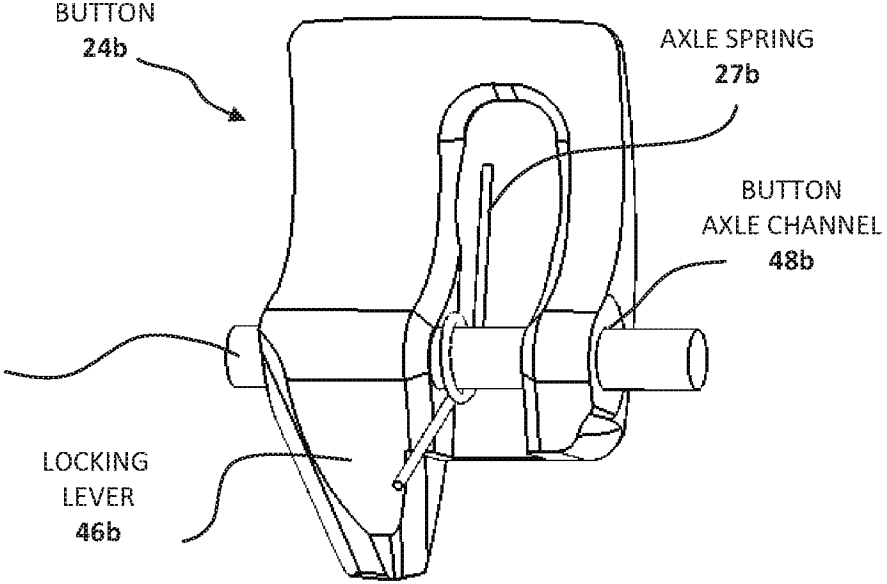
FIG. 6 is a back perspective view of the button 24*b*.

There are two generally square-shaped openings 26*a* and 26*b* located on opposite sides of the ball unit 12 for placement of corresponding buttons 24*a* and 24*b* which serve as actuators to lock the legs 20*a* and 20*b* in the extended position and to unlock the legs 20*a* and 20*b* to enable movement to the retracted position (FIG. 4A). Each of the buttons 24*a* and 24*b* is connected to the ball unit 12 by an axle 25*a* and 25*b* which fits into axle channels 28*a* and 28*b* formed in the body of the ball (FIG. 6). Each button 24*a* and 24*b* pivots on is corresponding axle 25*a* and 25*b* when pressed, as discussed in more detail hereinbelow.

The ball unit 12 also has a large barrel channel 30 which is designed to be aligned with the barrel axis X of the firearm, when the support assembly 10 is attached to the firearm. If the barrel is sufficiently long, as in the case of a rifle for example, the barrel will extend through the main ball channel 30 and emerge from the forward opening of the outer housing 44.

Figure 4D:
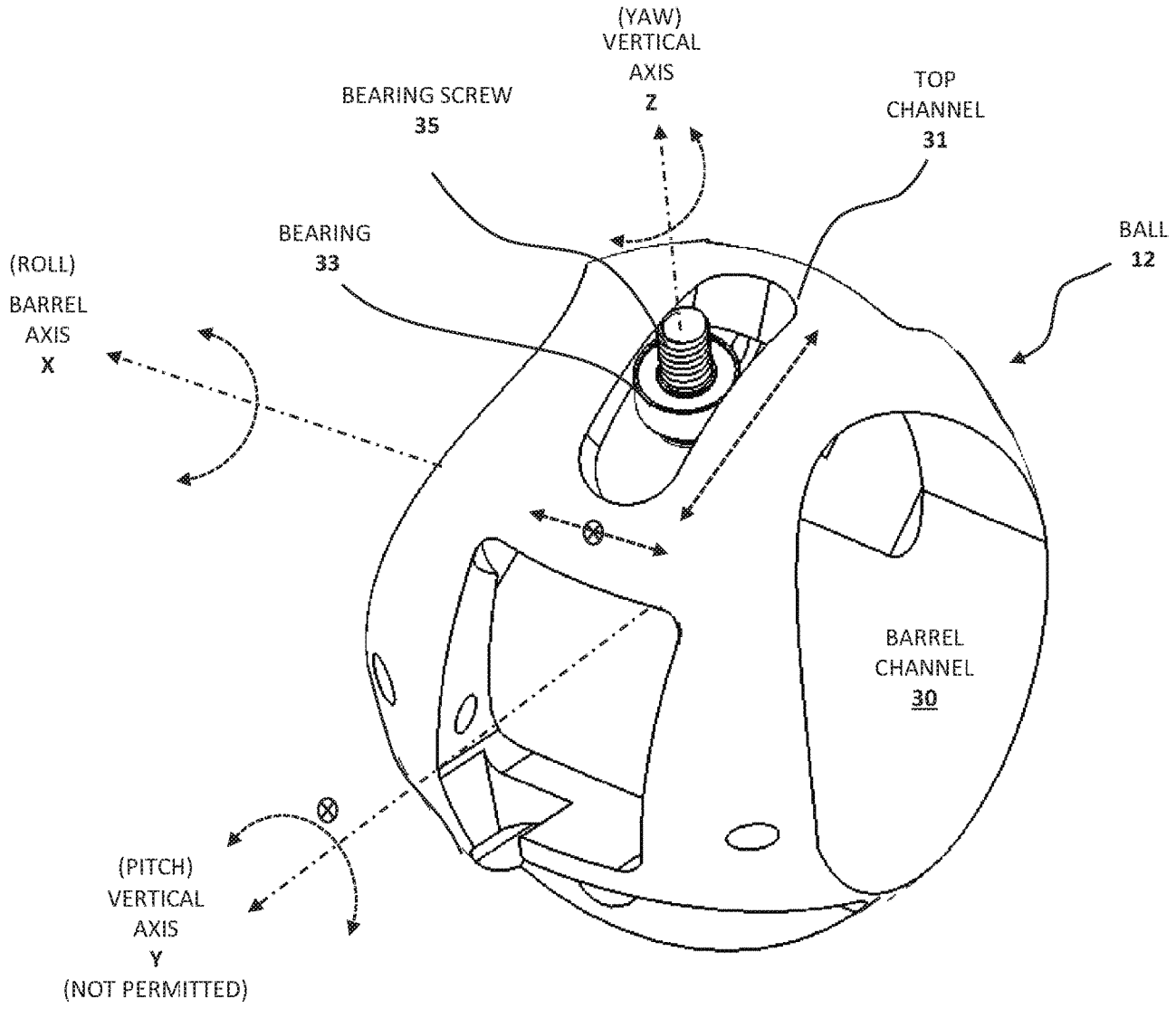
FIG. 4D is a top perspective view of the ball unit 12 showing the XYZ axes and the restriction of rotation of the lateral Y axis by the combination of the top channel 31, bearing 33 and bearing screw 35, which is connected to the top rail (not shown).

It can be seen in the top perspective view of FIG. 4D that the ball unit 12 also has a top channel 31 which retains a bearing 33 connected to the rail R (not shown in FIG. 4D) by a screw 35. The width of the top channel 31 effectively prevents rotation of the support assembly 10 about the Y axis (pitch) in order to prevent upward and downward motion of the retention elements 14 and 16 (while the ball unit 12 remains stationary). If rotation about the Y axis was permitted, such rotation could result in collapse of the support assembly 10. On the other hand, rotation about the X axis (roll) is permitted. Rolling motion of the support assembly 10 is advantageous for leveling a sighting scope (not shown) which would be attached to the rail R. The rolling motion is restricted by the length of the top channel 31. For example, rolling to the left would be allowed until the bearing 33 encounters the left end wall of the top channel 31. Likewise, rotation about the Z axis (yaw) is permitted. This motion allows the user to sweep the barrel axis laterally during the process of aiming at a target.

While rotation of the Y axis (pitch) of the support assembly is not permitted, the user remains able to tilt the barrel upward or downward by lowering or raising the butt stock of the firearm.

Figure 8:
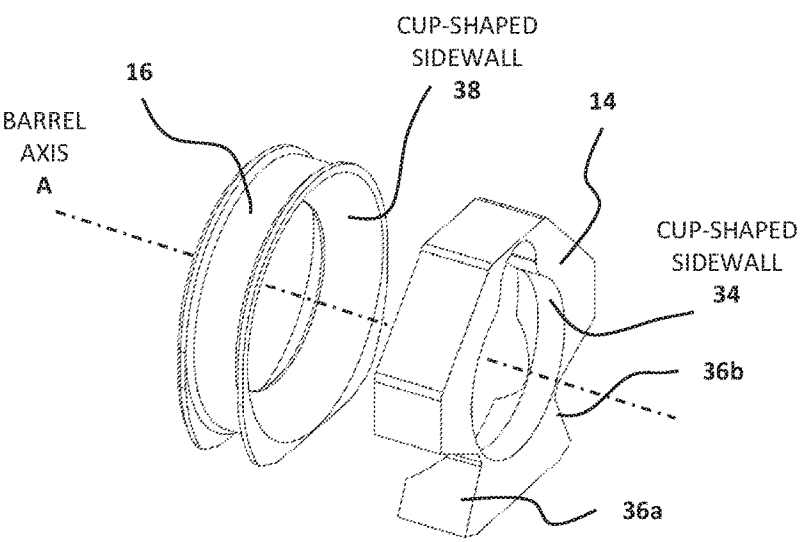
FIG. 8 is a side perspective view of the ball retention elements 14 and 16.
Figure 7:
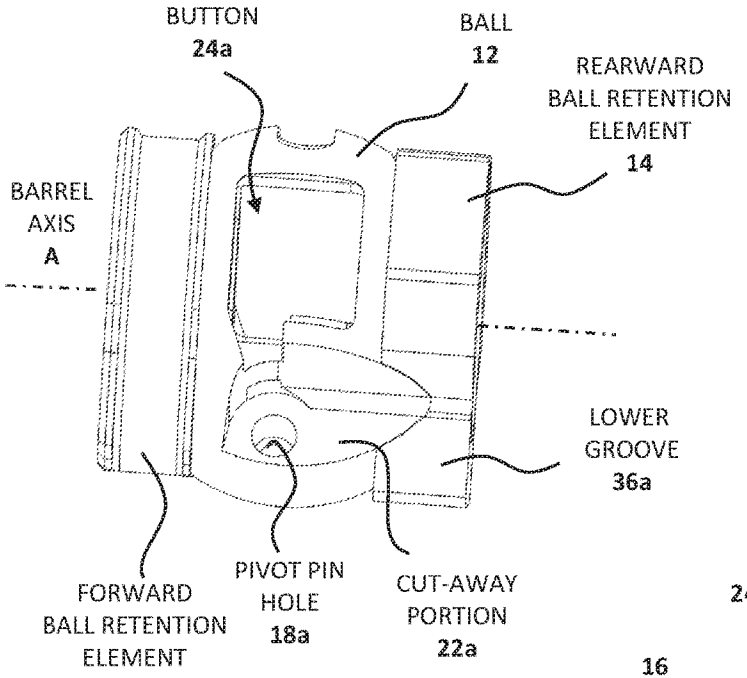
FIG. 7 is a side perspective view of the ball unit 12 with the ball retention elements 14 and 16 associated therewith.
Figure 9:
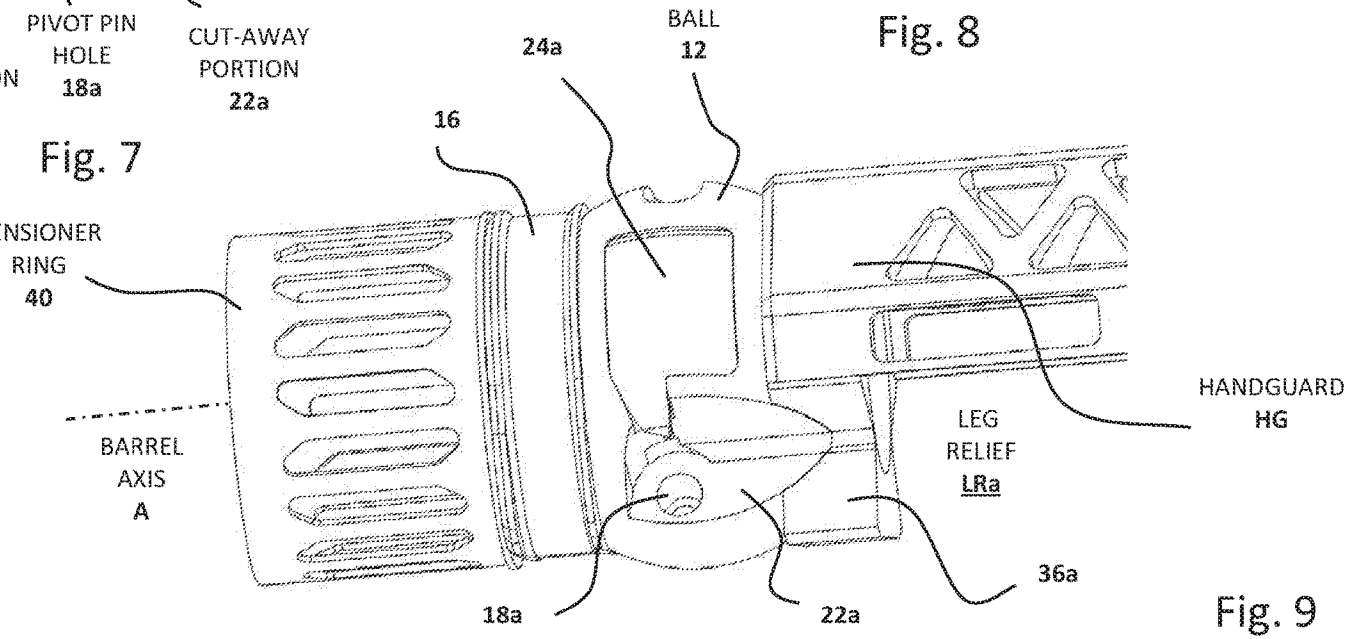
FIG. 9 is a side perspective view showing the ball unit 12, the arrangement of the forward ball retention element 16 with the tensioner ring 40 and the arrangement of the rearward ball retention element 14 with the handguard HG.

The features of the ball retention elements 14 and 16 are shown in FIGS. 7 and 8. It is seen that the rearward ball retention element 14 has an inner cup-shaped sidewall 34 and a pair of matching lower grooves 36*a* and 36*b* to provide corresponding spaces for the legs 20*a* and 20*b* when in the retracted position. The lower grooves 36*a* and 36*b* are aligned with the corresponding cut away portions 22*a* and 22*b* of the ball unit 12. The forward ball retention element 16 also has an inner cup-shaped sidewall 38 for retaining the forward end of the ball unit 12. The forward ball retention element 16 is provided with forward facing structure configured to connect to a tensioner ring 40 via a separate ring 42 (see FIG. 2) by threading or other means of connection to provide adjustable tension on the interaction between the forward outer surface of the ball unit 12 and the cup-shaped sidewall 38 of the forward ball retention element 16. In alternative embodiments, the tensioner ring 40 is threadingly connected directly to the forward ball retention element 16. By threadingly tightening the tensioner ring 40, the sliding relationship of the ball unit 12 within its socket (comprising the rearward and forward ball retention elements 14 and 16) is reduced to require more force in moving the barrel axis for aiming. With application of sufficient tension placed on the ball unit by the tensioner ring 40, the barrel axis X is effectively locked and rolling and yaw motions are prevented. This is useful in cases where an operator wishes to keep the firearm locked on a stationary target.

Figure 2:
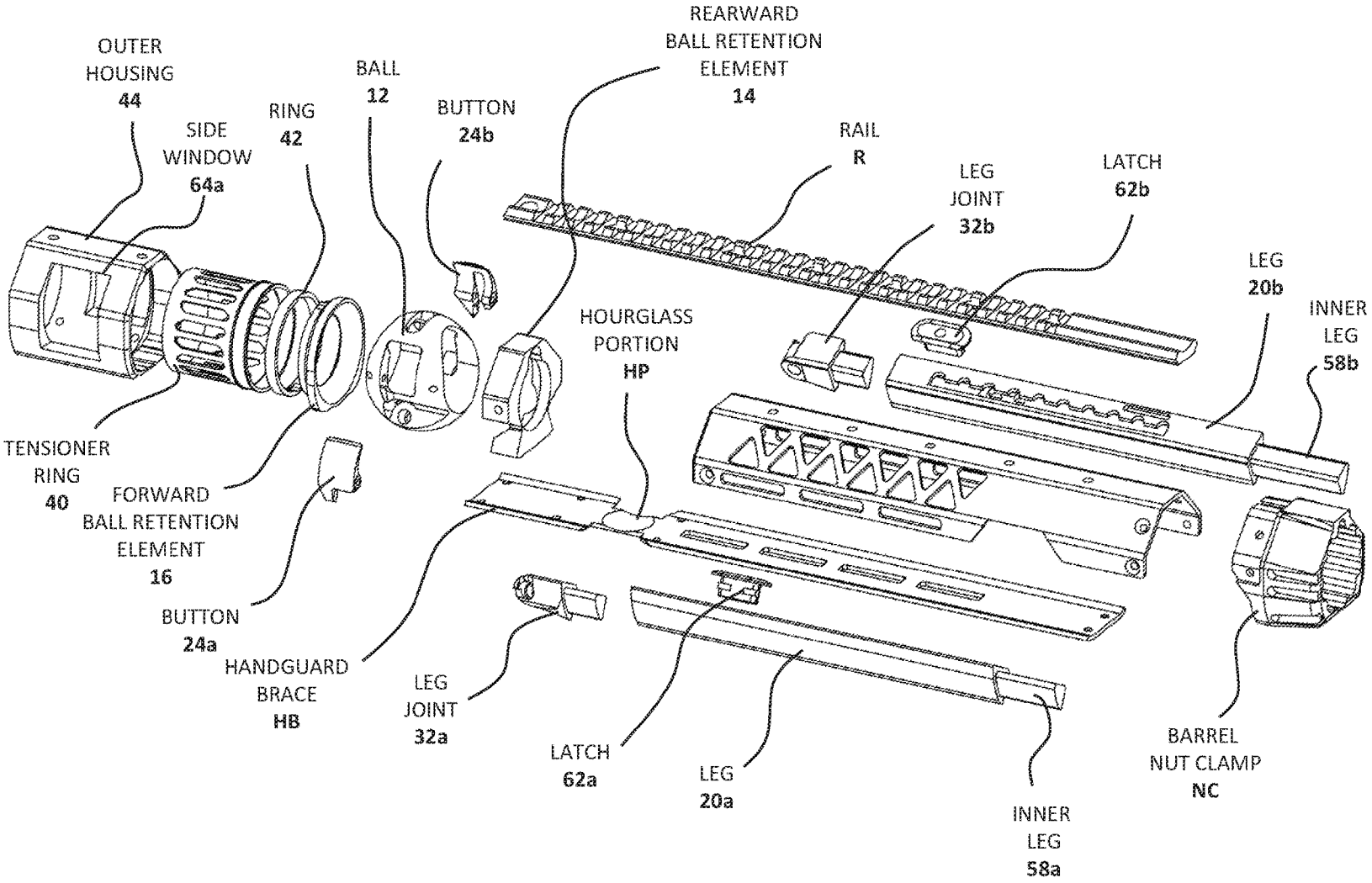
FIG. 2 is an exploded perspective view of the support assembly 10 and the associated handguard HG, handguard brace HB, rail R and barrel nut clamp NC.
Figure 3:
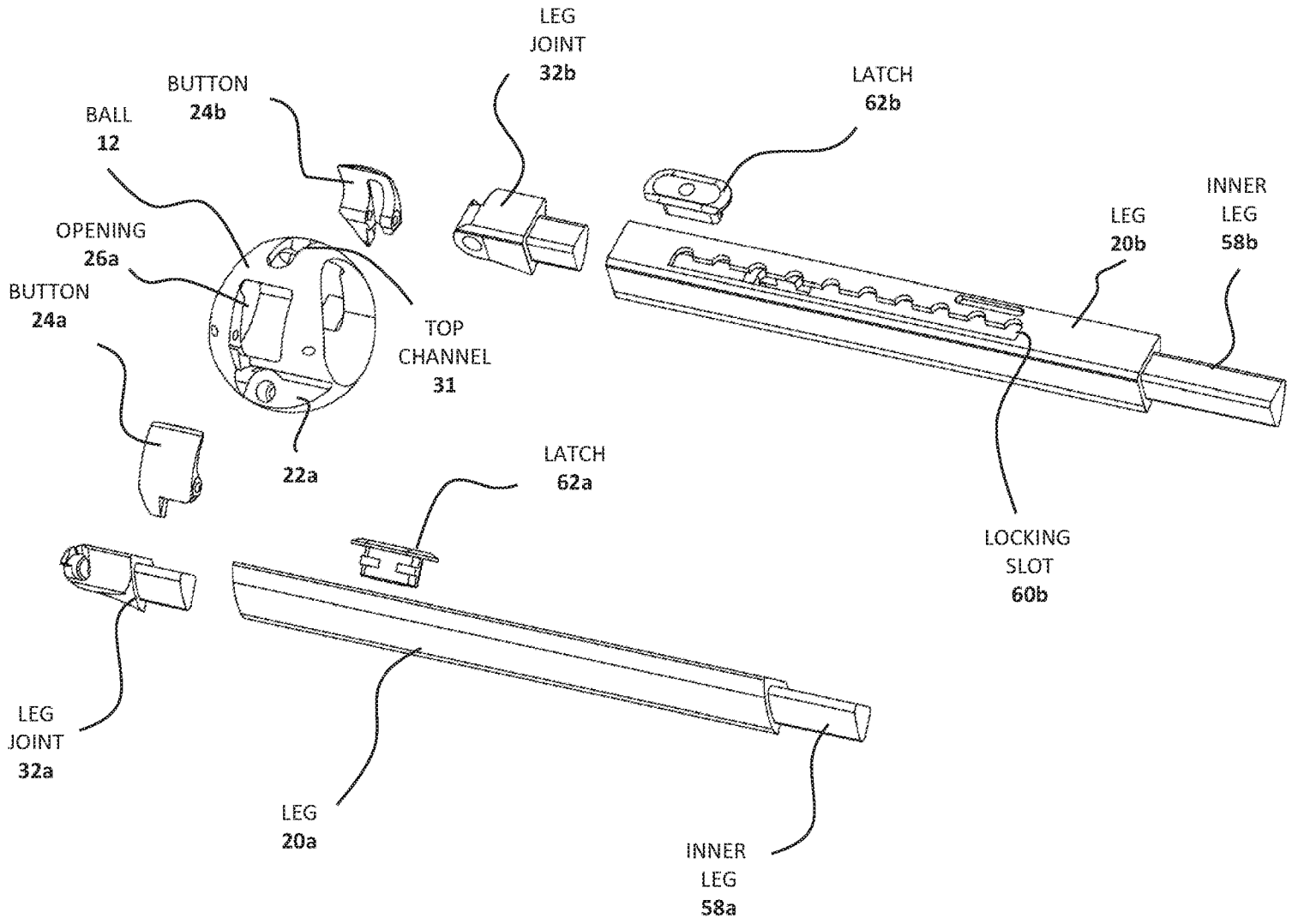
FIG. 3 is an exploded perspective view of the central components of the support assembly 10.

As shown in FIGS. 1 and 2, the assembly of the tensioner ring 40 and the forward ball retention element 16 is covered by an outer housing 44 which generally protects the tensioner ring and provides a point of connection to a support rail R which is an elongated member connected to the top of the handguard and spanning across the top of the support assembly 10 as shown in FIGS. 1A and 1B. A number of different types of support rails are known in the art and can be used with the present invention. Examples include the Picatinny rail, the 1913 rail and the Weaver rail, among others. Such rails are generally provided for the purpose of supporting other equipment such as scopes, lights and lasers, in a conventional manner. The outer housing 44 of this embodiment is hexagonal and is defined by a pair of opposed identical side windows 64*a* and 64*b* which allow a user to access and control the tension of the tensioner ring 40.

Figure 5:
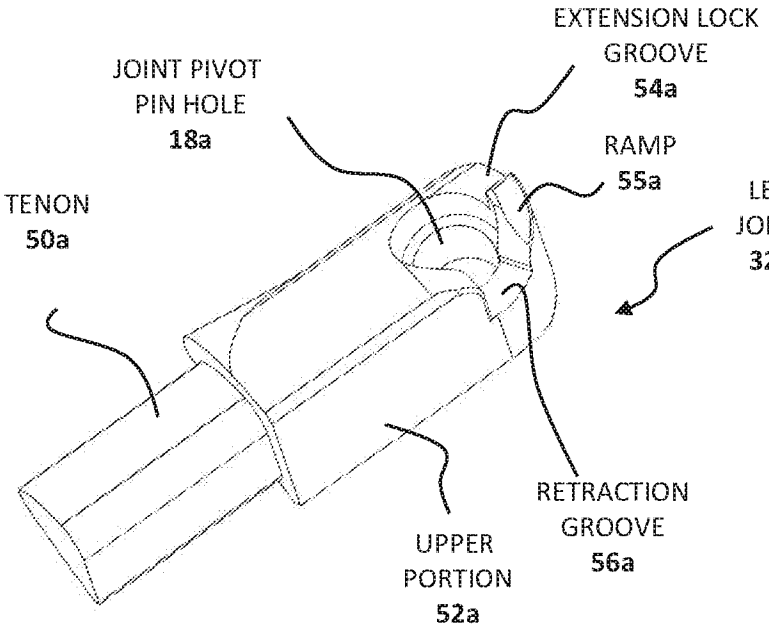
FIG. 5 is a side perspective view of the leg joint 32*a*.

The structure of one of the leg joints 32*a* is shown in FIG. 5. It is to be understood that the structure of the other leg joint 32*b* is a mirror image of leg joint 32*a* with otherwise identical features. Leg joint 32*a* has a lower tenon 50*a* which is dimensioned to fit into a corresponding mortise formed by an upper opening of leg 20*a* which is hollow, and an upper portion 52*a* defined by the presence of the joint pivot pin hole 18*a*. Adjacent the pivot pin hole 18*a* are a pair of grooves 54*a* and 56*a* which are separated by an intervening ramp 55*a*. Extension lock groove 54*a* is provided in alignment with the longitudinal axis of the leg joint 32*a* and the retraction groove 56*a* is provided approximately perpendicular to the longitudinal axis of the leg joint 32*a*.

The structure of one of the buttons 24*b* is shown in a back-end perspective view in FIG. 6. It is to be understood that the structure of the other button 24*a* is a mirror image of button 24*b* with otherwise identical features. It is seen in FIG. 6 that button 24*b* has a locking lever 46*b* and a button axle channel 48*b* for holding a button axle 25*b*. Pivoting on the longitudinal axis of the button axle 25*b* allows button 24*b* to move from a locked position where the entire outer surface of button 24*b* conforms to the surface of the ball unit 12 to an unlocked position where the part of the surface of button 24*b* extends into the cavity of the ball unit 12 and the locking lever 46*b* points away from the surface of the ball unit 12. An axle spring 27*b* is wrapped around the axle 25*b* as shown to provide a biasing force for holding the button in the locked position where the locking lever 46*b* occupies the extension lock groove 54*b*. In this position the outer contour of the button 24*b* is continuous with the outer contour of the ball unit 12. The biasing force is overcome by the user by pressing on the upper part of the button to disengage the locking lever 46*b* from the extension lock groove 54*b*.

Another feature of the present embodiment of the support assembly 10 is the ability to adjust the length of the legs 20*a* and 20*b*. The structural components contributing to this function are shown best in the exploded views of FIG. 2 and FIG. 3 in association with leg 20*b*. It is to be understood that the same features are provided in leg 20*a* but are not seen in the perspective view of leg 20*a*. The leg length adjustment function uses telescoping inner legs 58*a* and 58*b* which fit inside the outer legs 20*a* and 20*b*. It is seen in the perspective views of leg 20*b* that there is a locking slot 60*b* with a series of half-circle grooves formed therein. A latch 62*b* is provided to slide within the slot and enter a selected half-circle groove, or pair of grooves, to act as a stop for the inner telescoping movement of the inner leg. Thus, with reference to FIGS. 2 and 3, the shortest adjustment height of leg 20*b* will be provided when the latch 62*b* occupies the leftmost half-circle groove of the locking slot 60*b* and the highest adjustment height of leg 20*b* will be provided when the latch 62*b* occupies the rightmost half-circle groove of the locking slot 60*b*. Other mechanisms for locking telescoping legs are known in the art and can be adapted for use with the telescoping legs of the present embodiment, without undue experimentation. Embodiments using such alternative mechanisms are also within the scope of the invention.

A Second Embodiment of a Retractable Firearm Support Assembly

A second embodiment will now be described with reference to FIGS. 10 to 12 which use reference numerals in the 100 series. Features of this second embodiment which correspond to (but which are not necessarily structurally identical to) features of the first embodiment (FIGS. 1-9) are identified using similar reference numerals (for example, in the first embodiment, the ball unit is identified with reference numeral 12 and in the second embodiment, the ball unit is identified with reference numeral 112). This second embodiment has a number of features which are similar or identical to those of the first embodiment which function in a similar manner. Therefore, the ensuing description will be brief in favor of description of features which differ from those of the first embodiment.

In this second embodiment, it is to be understood that groups of components sharing the same reference numeral and having an additional letter identifier (e.g. 124*a* and 124*b*) represent structurally and functionally similar components which may be identical, substantially identical, symmetrical, or mirror images of each other. Because the exemplary embodiment is described with reference to perspective drawings, certain components existing in pairs may have only one of the two paired components visible in a given perspective drawing. It is to be understood from context and symmetry which is readily apparent to the skilled person, that any non-visible component of the pair is nonetheless present. Components identified using only letters (e.g. HG2, R2, NC2, N2 and HB2) refer to components which do not form part of the main support assembly of this embodiment but are connected to or otherwise associated with the support assembly. Certain kit embodiments of the invention may include such components.

Figure 10:
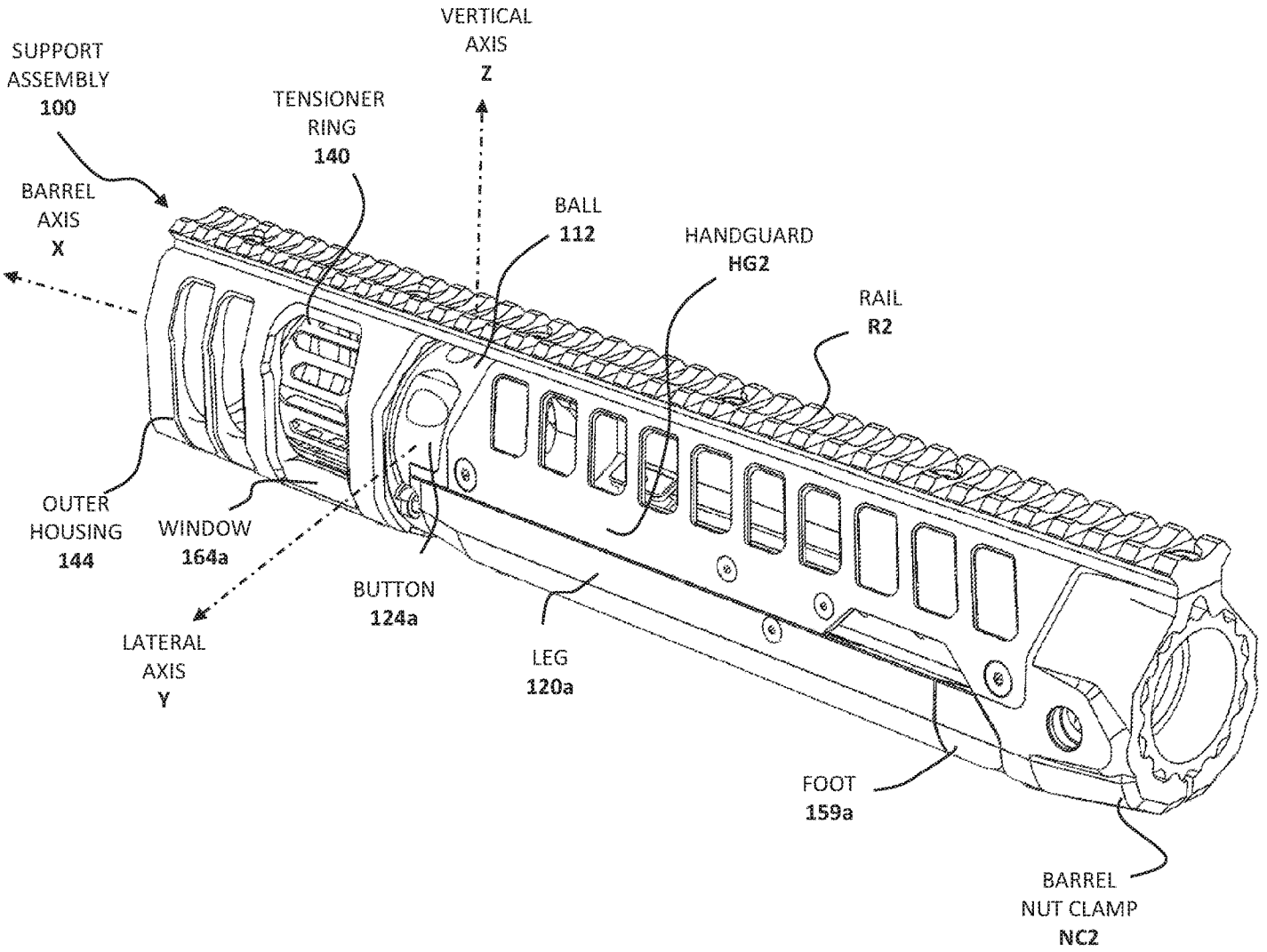
FIG. 10 is a side elevation view of a second embodiment of the invention 100.
Figure 11:
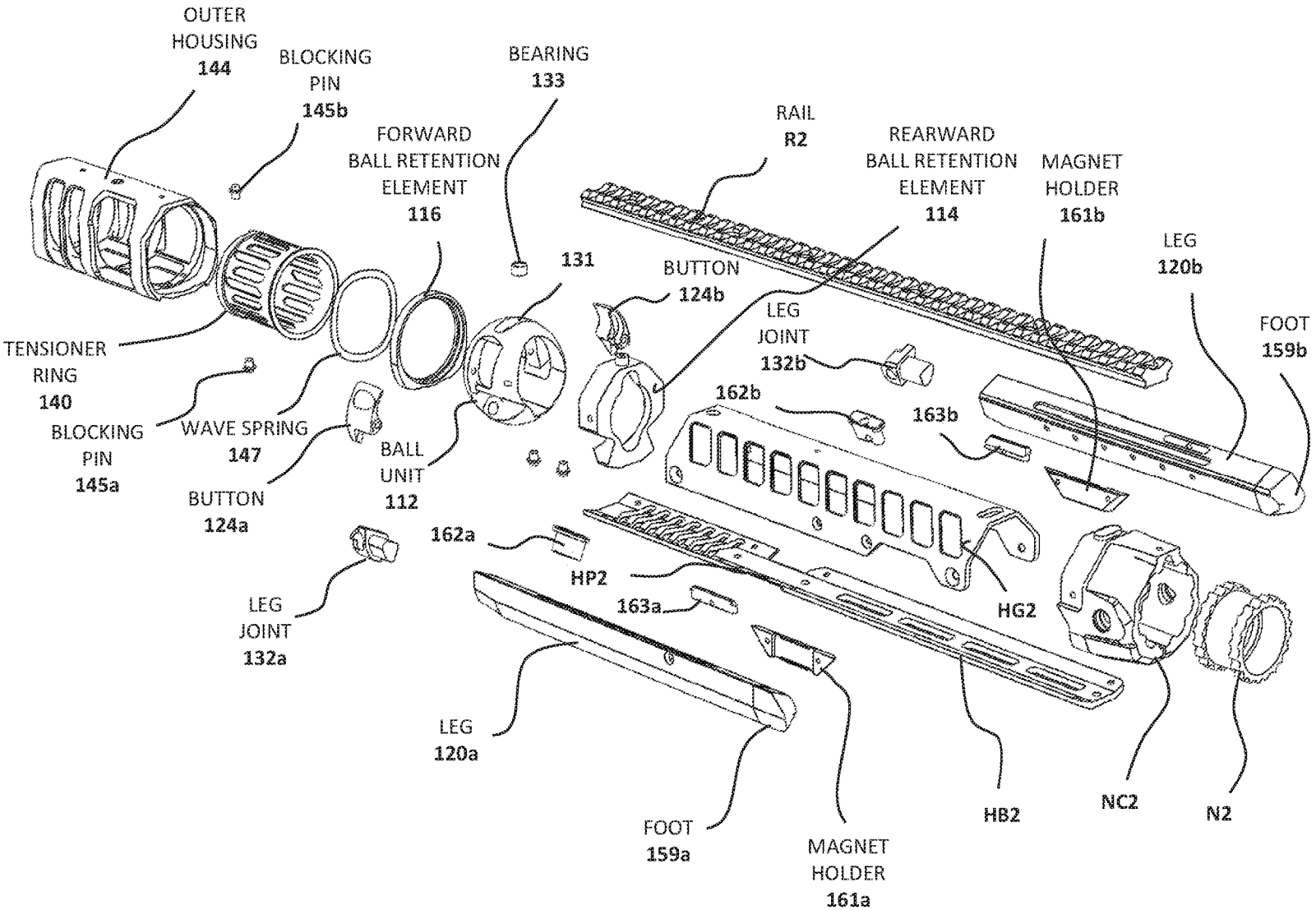
FIG. 11 is an exploded view of the embodiment of FIG. 10.
Figure 12A:
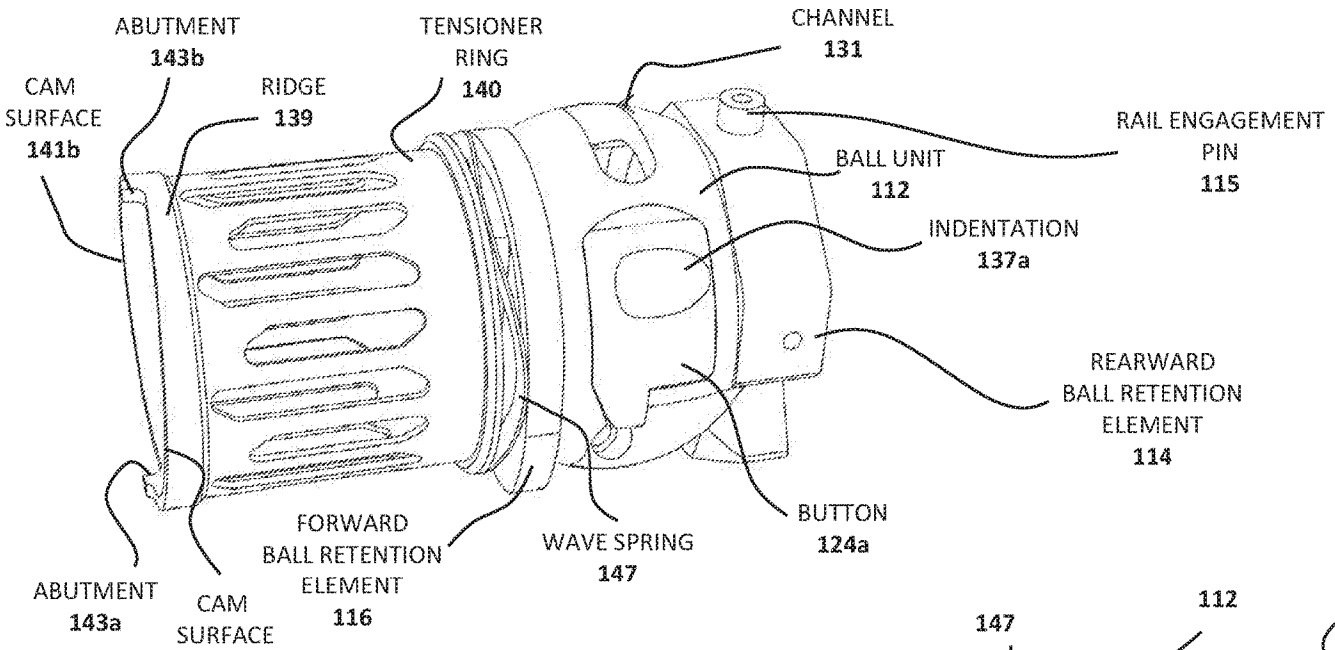
FIG. 12A is a side perspective view of selected and isolated portions of the same embodiment of FIGS. 10 and 11 to illustrate the tensioning mechanism showing the ball unit 112, and the arrangement of the forward ball retention element 116 with the tensioner ring 140.

It is seen in FIG. 10 (side perspective view of the assembly 100 in the retracted position) and FIG. 11 (exploded perspective view) that the overall structure of the retractable firearm support assembly 100 is similar to that of the first embodiment 10. The firearm structure itself is not shown in order to simplify the description of the components of the support assembly 100. It is to be understood that the handguard HG2, the lower handguard brace HB2, the rail R2 and the barrel nut clamp NC2 and the nut N2 are extension components which do not form part of the support assembly 100 and are configured for connection to the firearm in a conventional manner. The handguard HG2 and the lower handguard brace HB2 with the hourglass portion HP2 are designed to provide leg relief spaces to be occupied by the outer legs 120*a* and 120*b* in the retracted position in a manner similar to that described for the first embodiment 10 (not shown in FIGS. 10-12).

The support assembly 100 is shown attached to the forward end of the handguard HG2 in FIG. 10. As for the first embodiment, when the support assembly 100 is attached to a firearm, the barrel of the firearm will extend along the longitudinal barrel axis X, and in most cases, will extend through the end opening of the outer housing 144 in the support assembly 100. The lateral axis Y and the vertical axis Z have the same arrangement as for the first embodiment 10 with rotation about the X axis (in a manner analogous to the "roll" of an aircraft), being permitted and rotation about the Z axis (in a manner analogous to the "yaw" of an aircraft) being permitted, but rotation about the Y axis not being permitted.

The central component of the support assembly 100 is a ball unit 112 whose features and pivoting function are similar to the pivoting function described above for the first embodiment 10. The ball unit 112 is held between opposing ball retention elements including a rearward ball retention element 114 and a forward ball retention element 116, which having inner cup-shaped sidewalls that together form a socket for holding the ball unit 112 in a manner that allows swiveling of the support assembly 100 for aiming of the firearm when the support assembly 100 is in the extended (deployed) position (not shown, but understood to generally resemble the arrangement shown in FIG. 1). The rearward retention element 114 (see FIGS. 11 and 12) is similar to the rearward retention element 14 of the first embodiment 10, with a notable exception being that it is immobilized with respect to the upper rail R2 with an upper rail engagement pin 115 (see FIG. 12) extending upward from the top surface of the rearward retention element 114 to fit into a corresponding cavity (not shown) in the rail R2. In this embodiment, this arrangement is secured by a bolt threaded from the outer top of the rail R2. The ball unit 112 also has a top channel 131 which retains a bushing 133 connected to the rail R2.

The second embodiment 100 has a different tensioning mechanism than that of the first embodiment 10. In the first embodiment 10, the tensioning mechanism operates by coupling of the forward retention element 16 to the ring 42 which threads onto the tensioner ring 40. In contrast, the tensioning mechanism of the second embodiment 100, illustrated in FIGS. 12A and 12B does not employ a threading arrangement. The forward retention element 116 differs from the retention element 16 of the first embodiment 10 in being significantly thinner. A wave spring 147 is placed between the rearward edge of the tensioner ring 140 and the forward edge of the forward retention element 116.

Figure 12B:
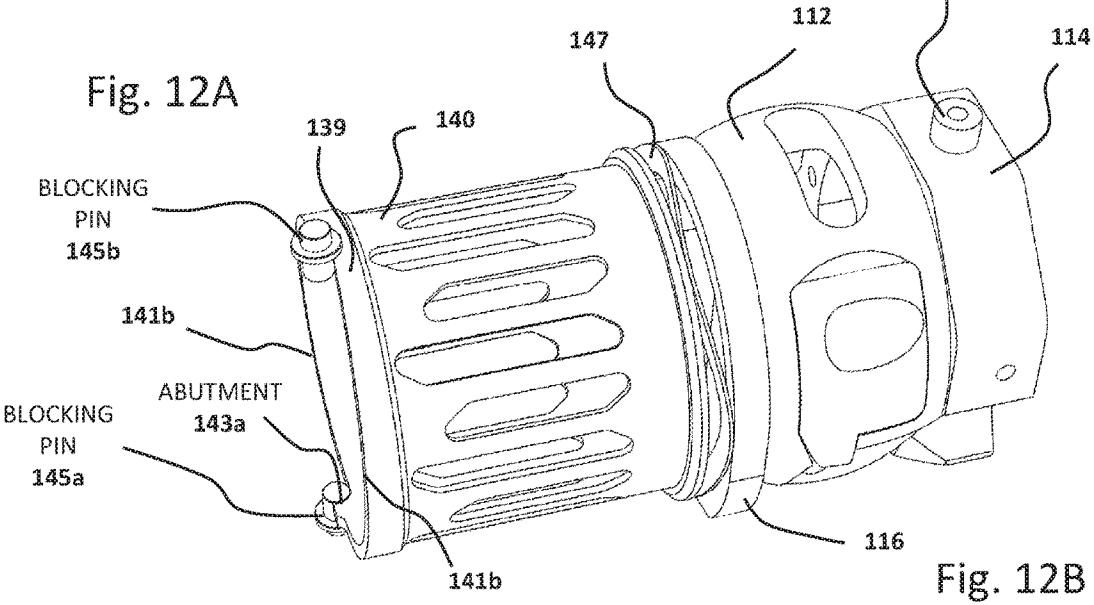
FIG. 12B is a perspective view generally similar to the view of FIG. 12A additionally showing opposed blocking pins 145*a* and 145*b* in contact with corresponding abutments 143*a* and 143*b* at the respective ends of sloping cam surfaces 141*a* and 141*b* at the forward edge of the forward ridge 139 of the tensioner ring 140.

Compression of the wave spring 147 by the tensioner ring 140 places pressure on the forward ball retention element 116 to compress the forward end of the socket and reduce the pivoting motion of the ball unit 112. The compression/extension provided by the tensioner ring 140 is derived from half-diameter forward cam surfaces 141*a* and 141*b* which terminate at corresponding opposed abutments 143*a* and 143*b* on the forward ridge 139 of the tensioner ring 140 (best seen in FIG. 12A). Cam surface 141*a* slopes to a reduced ridge width toward abutment 143*b* and cam surface 141*b* slopes to an increased ridge width toward abutment 143*a*. In FIG. 12B blocking pins 145*a* and 145*b* are shown. These blocking pins 145*a* and 145*b* extend downward from the outer housing 144 (the outer housing 144 is omitted from FIGS. 12A and 12B in order to show the components contained therein). These blocking pins 145*a* and 145*b* are in continuous contact with the cam surfaces 141*a* and 141*b* when the tensioner ring 140 rotates but cannot move past the abutments 143*a* and 143*b*. Therefore, when the tensioner ring 140 is rotated clockwise from the point of view looking forward down the barrel axis, the cam surfaces 141*a* and 141*b* riding on the blocking pins 145*a* and 145*b* move towards the wider portions of the ridge 139. This provides the effect of increasing the length of the tensioner ring 140. Since the tensioner ring occupies a fixed space, it then places more force on the compensating wave spring 147 and provides tightening of the pivoting mechanism. Likewise, when the tensioner ring 140 is rotated counterclockwise from the point of view looking forward down the barrel axis, the cam surfaces 141*a* and 141*b* riding on the blocking pins 145*a* and 145*b* move towards the thinner sides of the ridge 139. This provides the effect of reducing the length of the tensioner ring 140. This removes force directed against the wave spring 147 and loosens the pivoting mechanism.

The pivoting motion of the ball unit 112 inside the socket formed by the forward and rearward retention elements 116 and 114 is similar to that of the first embodiment 10 and the leg locking buttons 124*a* and 124*b* associated with the ball unit 112 also operate in a similar manner (only button 124*a* is visible in the perspective view of FIG. 12). One different design aspect in this embodiment is that the leg locking buttons 124*a* and 124*b* are provided with corresponding indentations 137*a* and 137*b* to assist the user in identifying the best place to press down on the buttons 124*a* and 124*b* to lock and unlock the legs. Otherwise, the ball unit 112 has the same features as ball unit 12 of the first embodiment 10 and these same features function in a similar manner. As such, the corresponding similar features of the second embodiment are not described here.

As shown in FIGS. 10 and 11, the assembly of the tensioner ring 140 and the forward ball retention element 116 is covered by an outer housing 144 which generally protects the tensioner ring and provides a point of connection to support rail R2. The rail R2 is an elongated member connected to the top of the handguard and spanning across the top of the support assembly 100. In this second embodiment, the outer housing 144 is longer than that of the first embodiment 10, simply for the purpose of providing an additional support area for attachment of supplemental equipment such as a scope, a light, a laser or any other item whose inclusion is appropriate. As described for the first embodiment 10, a number of different types of support rails are known in the art and can be used with the present invention. Examples include the Pictatinny rail, the 1913 rail and the Weaver rail, among others. Such rails are generally provided for the purpose of supporting other equipment such as scopes, lights and lasers, in a conventional manner. The outer housing 144 of this embodiment is hexagonal and is defined by a pair of opposed side windows 164*a* and 164*b* which allow a user to access and control the tension of the tensioner ring 140.

The leg joints 132*a* and 132*b* (see FIG. 11) operate in a similar manner as in the first embodiment 10 to provide extension lock grooves for locking the legs in the extended position.

Another feature of the present embodiment of the support assembly 100 is the ability to adjust the length of the legs 120*a* and 120*b* with locking provided by latches 162*a* and 162*b*. The latches 162*a* and 162*b* slide in corresponding leg grooves in a similar manner as described for the first embodiment but the latches are locked into one of six positions defined by six holes drilled into the side of the legs 120*a* and 120*b*. The latches 162*a* and 162*b* house a ball bearing. When one of the latches 162*a* and 162*b* is depressed the corresponding ball bearing does not impede the travel of the latch in the leg groove. When the latch is released, the corresponding ball bearing settles into one of the holes and impedes the motion of that latch. The latches 162*a* and 162*b* are attached to inner telescoping legs (not shown) that extend when the latches 162*a* and 162*b* are moved. Feet 159*a* and 159*b* are attached to the bottom of these inner legs which are not visible in FIGS. 10 and 11 because they are telescoped inside the outer legs 120*a* and 120*b*. Other mechanisms for locking telescoping legs are known in the art and can be adapted for use with the telescoping legs of the present embodiment, without undue experimentation. Embodiments using such alternative mechanisms are also within the scope of the invention.

The second embodiment 100 includes a pair of magnet holders 161*a* and 161*b* which attach to the handguard HG2 to retain magnets for attracting corresponding ferromagnetic bars 163*a* and 163*b* that fit into grooves in legs 120*a* and 120*b* The magnets held by the magnet holders 161*a* and 161*b* attract the ferromagnetic bars 163*a* and 163*b* with sufficient force to hold the legs 120*a* and 120*b* in place in the retracted position.

Kits and Methods of Construction of the Support Assembly

Another aspect of the invention is a kit for construction of a support assembly. The kit includes at least some or all of the disassembled parts of either the first embodiment or the second embodiment, for example, as shown in the entire exploded views of FIGS. 2 and 11 which are identified using reference numerals in the series from 12 to 64 and 112 to 164 and not including parts identified by reference letters. The subsequent description is with reference to the first embodiment. Construction of the second embodiment will follow similar steps.

In some embodiments, the kit also includes at least some or all of the parts identified by reference letters (such as the handguard HG, the handguard adapter HA and the barrel nut clamp NC, for example). In the example assembly procedure described below with respect to the first embodiment, the skilled person will recognize that variations in the order of steps are possible and that such variations are encompassed by the invention as claimed. In certain embodiments, the kit includes instructions for construction of the support assembly in association with one or more firearm extension components such as a handguard, a handguard adapter, a stock, a shroud or a chassis.

In one example of a process for constructing the support assembly 10 of the first embodiment, the parts are assembled as follows. The buttons 24*a* and 24*b* are installed in the ball unit 12 by placement in their respective openings 26*a* and 26*b* and the corresponding axles 25*a* and 25*b* are inserted through the axle channels 28*a* and 28*b* to pivotably connect the buttons 24*a* and 24*b* to the ball unit. The leg joints 32*a* and 32*b* are connected to the upper openings of the legs 20*a* and 20*b* and connected to the ball unit by placement of pivot pins in the pivot pin holes 18*a* and 18*b*. Now the legs 20*a* and 20*b* can be locked in either the extended or retracted positions. The inner legs 58*a* and 58*b* are inserted into the open bottoms of the legs 20*a* and 20*b*. Optionally, the lower ends of the inner legs 58*a* and 58*b* are each provided with feet (not shown) made of rubber or other suitable material to enhance surface friction and improve stability of the deployed support assembly 10. The latches 62*a* and 62*b* are installed in their respective locking slots 60*a* and 60*b* and attached to inner legs 58*a* and 58*b* with a screw.

The handguard HG and handguard brace HB are connected by connecting the barrel nut clamp NC to the rearward end using the rightmost bolt holes of the handguard brace HB (see FIG. 1B and FIG. 2) and the rearward bolt holes in the handguard HG and the corresponding holes in the barrel nut clamp NC, or alternatively, a handguard adapter HA can be connected instead of the barrel nut clamp NC (see FIG. 1A). It is seen in the exploded view of FIG. 2 that the forward end of the handguard brace HB includes bolt holes (the pair of holes in the handguard brace HB to the immediate right of the hourglass portion HP) for connection of the rearward ball retention element 14 to the handguard brace HB adjacent to the handguard HG. The ball unit 12, is then sandwiched between the forward ball retention element 16 and the rearward ball retention element 14. Then the intermediate ring 42 is threadingly connected to the tensioner ring 40 and the outer housing is placed over the tensioner ring 40 and the forward retention element 16 and bolted to the forward end of the handguard brace HB at the two pairs of bolt-holes provided. Then the rail R is connected to the top of the handguard HG and to the top of the outer housing 44. Assembly of the second embodiment will follow similar steps with the exception of threading of the tensioner ring 140. Instead, the tensioner ring is aligned with its cam surfaces 141*a* and 141*b* in contact with the opposed blocking pins 145*a* and 145*b* extending from the outer housing 144. The wave spring 147 is placed between the forward retention element 116 and the rear edge of the tensioner ring 140.

Operation of the Support Assembly of the First Embodiment

During operation of the support assembly 10, beginning from the retracted position (wherein the legs 20*a* and 20*b* are folded and locked into their respective leg reliefs LRa and LRb), the user decides to deploy the support assembly 10 of the firearm for precise aiming at a target. The user holds the firearm (for example by supporting the butt stock of the firearm under the right arm) and grabs the rearward end of leg 20*a*. This may be facilitated by placing at least one finger in the rearward handguard slot HSa and pushing downward on the retracted leg 20*a*. The leg 20*a* is then rotated away from the leg relief LRa. The force applied to the leg by the operator separates the magnetic connection created by the leg magnet (not shown) and the handguard magnet not shown) that holds the leg in its retracted (stowed) position. The rotating force also forces the locking lever 46*a* to rotate on the button axle 25*a* out of retraction groove 56*a* and along the ramp 55*a* on the leg joint 32*a*. As the leg 20*a* is rotated into the fully extended position, the ball button axle spring 27*a* (which is similar to axle spring 27*b* shown in FIG. 6) forces the locking lever 46*a* into the extension lock groove 54*a*, locking the leg 20*a* in the extended position. The process is then repeated for leg 20*b*.

To retract or stow the legs 20*a* and 20*b* the operator presses the upper portions of both buttons 24*a* and 24*b* on the ball unit 12 to cause rotation of the buttons 24*a* and 24*b* about their respective ball button axles 25*a* and 25*b* to disengage the locking levers 46*a* and 46*b* from their corresponding extension lock grooves 54*a* and 54*b* in the leg joints 32*a* and 32*b* with subsequent movement down the respective ramps 55*a* and 55*b* in the leg joints 32*a* and 32*b*. The buttons 24*a* and 24*b* may be pressed simultaneously or sequentially. The legs 20*a* and 20*b* rotate into their retracted positions in the leg reliefs LRa and LRb of the handguard HG and are held in place by the attractive magnetic force between the corresponding leg magnets and handguard magnets (not shown). At this stage the locking levers 46*a* and 46*b* occupy the corresponding retraction grooves 56*a* and 56*b*.

Next, any desired height adjustments to the legs 20*a* and 20*b* are made using the telescoping inner legs 58*a* and 58*b* with latching of the inner legs 58*a* and 58*b* by placing the latches 62*a* and 62*b* in the desired pair of half-circle grooves in the locking slots 60*a* and 60*b*. The support assembly 10 is then deployed with the bottoms of the inner legs 58*a* and 58*b* or optional feet attached thereto (not shown) resting on the ground and supporting the firearm. This fixes the position of the support assembly 10 with respect to the ground.

The user may then train the barrel of the firearm at a target by aiming. At this time, the ball unit 12 remains stationary because the locked and deployed legs 20*a* and 20*b* prevent any rotation of the ball. However, the socket formed by retention elements 14 and 16 can rotate around the ball, allowing rolling and yaw of the barrel because both of the retention elements 14 and 16 are in a fixed position with respect to the barrel but not with respect to the ball. The ball unit 12 thus provides a fixed swivel point for rolling and yaw of the barrel. Once the barrel is trained on the target, it may be desirable to reduce movement of the barrel. This is done by rotating the tensioner ring 40 in a direction which threads the tensioner ring off of threads on the intermediate ring 42 extending the length of the assembly created by threaded connection of the tensioner ring 40 and the intermediate ring 42. This provides pressure against the forward retention element 16 which is transmitted to the ball unit 12, thereby restricting motion of the forward retention element 16 with respect to the ball unit 12. Because the rearward retention element 14 is fixed to the forward end of the handguard HG and to the handguard brace HB, the movement of the entire assembly 10 is restricted by the tension. With sufficient tension applied, the panning and canting movements can be adjusted to suit the user's preference.

While this section has focused on operation of the first embodiment, it is to be understood that operation of the second embodiment is substantially similar except for the mechanism of the tensioner ring 140 which has been described in sufficient detail above with respect to FIG. 12.

Alternative Embodiments

The skilled person will recognize that a number of alternative embodiments exist, which are within the scope of the invention. One such embodiment has a ball unit immobilized with respect to the firearm extension component, for example, by fusing the ball to the extension component and providing a socket which can move with respect to the ball. In one example of such an arrangement, the socket is formed by forward and rearward ball retention elements, each with a cupped surface conforming to the outer surface of the ball. The legs of the support assembly are attached to the lower ball retention member instead of to the ball itself as in the main example embodiment of FIGS. 1-9. In this alternative embodiment, the retention members are fixed in place when the legs are extended and deployed and the ball swivels within the socket formed by the retention members when the user moves the barrel axis while aiming at a target.

Alternative embodiments are provided with alternate locking and retention mechanisms. Alternative embodiments include a third leg (to provide a tripod-type support)

with the third leg also fitting into a corresponding third leg relief in the firearm extension (not shown). The skilled person has the ability to redesign the ball unit and the firearm extension such as a handguard, stock, shroud or chassis to accommodate such a third leg in the retracted position in accordance with design principles described herein, without undue experimentation.

Furthermore, features unique to either the first or second embodiments described herein may be combined in different compatible combinations to arrive at additional embodiments of the invention. One such combination is based on the first embodiment and includes substitution of the components involved in the tensioning mechanism of the first embodiment with the components of the tensioning mechanism of the second component. Other combinations are also possible and are within the scope of the invention.

EQUIVALENTS AND SCOPE

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. A retractable support assembly for a firearm, the assembly comprising:

a) a swiveling support structure configured for attachment to or adjacent to the forward end of a firearm extension component on the firearm, the support structure, when attached, being substantially centered on the longitudinal axis of the firearm barrel and permitting movement of the longitudinal axis of the firearm barrel relative to a position fixed by deployment of the assembly for variable aiming of the firearm, the support structure comprising a central ball unit defined by a channel for passage of a barrel of the firearm therethrough, the ball unit configured for rotatable movement within a socket formed by a rearward ball retention element and a forward ball retention element each including a curved inner ball contact surface and an opening for passage of the barrel of the firearm therethrough, wherein the rearward ball retention element is connected directly or indirectly to the extension component; and b) a plurality of legs pivotably connected to the support structure for movement between an extended position, wherein the assembly supports the outer end of the longitudinal axis of the firearm and a retracted position.

2. The retractable support assembly of claim 1, wherein, in the retracted position, each of the legs of the plurality of legs resides within a corresponding relief area provided in the extension component with a surface of each leg forming part of the outer contour of the extension component.

3. The retractable support assembly of claim 1, wherein the extension component is a handguard, gunstock, shroud, or chassis.

4. The retractable support assembly of claim 1, wherein the extension component includes a bottom brace member and a bottom of the rearward retention element is connected to the brace member.

5. The retractable support assembly of claim 1, further comprising a leg-locking mechanism connected to the support structure for locking the legs in the extended position.

6. The retractable support assembly of claim 5, wherein the locking mechanism is provided by a pair of opposing buttons placed in corresponding openings in the ball unit, each button movable between a locked position which prevents movement of the corresponding leg and an unlocked position which allows movement of the corresponding leg between the retracted and extended positions.

7. The retractable support assembly of claim 6, wherein the buttons are each connected to the ball unit by an axle extending through a button axle channel and into opposing ball axle channels, the axle providing a pivot axis for movement between the locked position and the unlocked position.

8. The retractable support assembly of claim 7, wherein the ball unit is defined by a pair of opposed cut away sections, each providing a connection point for a pivot pin connection of a leg joint to the ball unit and allowing movement of the leg joint between the extended and retracted positions via pivoting of the leg at the pivot pin connection.

9. The retractable support assembly of claim 8, wherein the buttons each include a locking lever configured to rest inside an extension lock groove of the leg joint when the corresponding leg is extended and locked, and is configured to rest inside a retraction groove of the leg joint when the corresponding leg is retracted.

10. The retractable support assembly of claim 1, wherein the rearward retention element is defined by opposed lower grooves aligned with the corresponding cut away sections to provide a space for the corresponding legs.

11. The retractable support assembly of claim 1, further comprising an adjustment mechanism provided by a tensioner ring configured to exert variable pressure on a spring member located between the tensioner ring and the forward retention element, wherein rotation of the tensioner ring in one direction causes tightening of the pivoting motion of the ball unit, and wherein rotation of the tensioner ring in the other direction causes loosening of the pivoting motion of the ball unit.

12. The retractable support assembly of claim 11, further comprising an outer housing for generally covering the tensioner ring and the forward ball retention element, the outer housing having side windows for a user to access and control the tensioner ring.

13. The retractable support assembly of claim 12, wherein the outer housing is immobilized with respect to the extension component by connection of the top of the outer housing to the top of the extension component with an elongated member.

14. The retractable support assembly of claim 13, wherein the elongated member is at least one of a Picatinny rail, a Weaver rail or a 1913 rail.

15. The retractable support assembly of claim 1, wherein the length of each leg of the plurality of legs is telescopically adjustable.

16. The retractable support assembly of claim 1, wherein movement of the longitudinal axis of the firearm is restricted to a rolling motion caused by rotation of the longitudinal axis and to yaw motion caused by rotation of the vertical axis.

17. A kit of parts for installing a retractable support assembly on a firearm, the kit comprising the retractable support assembly of claim 1 and instructions for constructing the retractable support assembly on the firearm.

18. The kit of claim 17, further comprising a replacement handguard to replace the extension component of the firearm, the replacement handguard configured for attachment to a firearm in a conventional manner and defined by a pair of leg relief areas for holding the legs of the assembly in the retracted position.

19. The kit of claim 18, wherein the replacement handguard has an outer surface contour shaped to be continuous with outer surfaces of the legs in the retracted position, thereby providing a smooth combination of outer leg surfaces and replacement handguard surfaces to facilitate gripping of the replacement handguard and legs by a user.

20. The kit of claim 19, further comprising operational instructions describing movement of the legs between the extended position and the retracted position.

* * * * *